US006402295B1

(12) United States Patent
Narushima

(10) Patent No.: US 6,402,295 B1
(45) Date of Patent: Jun. 11, 2002

(54) INK JET PRINTING APPARATUS AND CONTROL METHOD THEREOF

(75) Inventor: Toshio Narushima, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 08/861,521

(22) Filed: May 22, 1997

(30) Foreign Application Priority Data

Jun. 3, 1996 (JP) ..... 8-140216

(51) Int. Cl.[7] ..... B41J 2/15
(52) U.S. Cl. ..... 347/40; 347/12; 347/43
(58) Field of Search ..... 347/15, 41, 43, 347/12, 40, 5, 14, 98

(56) References Cited

U.S. PATENT DOCUMENTS 4,614,953 A * 9/1986 Lapeyre ..... 347/43
5,686,944 A * 11/1997 Takagi et al. ..... 347/41

* cited by examiner

*Primary Examiner*—Lamson D. Nguyen
(74) *Attorney, Agent, or Firm*—Ronald P. Kananen; Rader, Fishman & Grauer PLLC

(57) ABSTRACT

An ink jet printing apparatus has a print head and a control section. The print head is moved with respect to a recording medium in the main scanning direction. The print head has N ink jetting portions arranged in the auxiliary scanning direction which is perpendicular to the main scanning direction. The N ink jetting portions are arranged at intervals that are K times the resolution element interval, where the ratio K/N becomes a fraction in lowest terms. As the print head is scanned with respect to the recording medium in the main and/or auxiliary scanning direction, the control section causes the N ink jetting portions of the print head to sequentially start their jetting operations upon reaching a print start position of the recording medium.

12 Claims, 11 Drawing Sheets

INK JET PRINTING APPARATUS AND CONTROL METHOD THEREOF

BACKGROUND

1. Field of the Invention

The present invention relates to an ink jet printing apparatus and a control method thereof. In particular, the invention relates to an ink jet printing apparatus which can prevent unnecessary jetting of ink droplets and a control method thereof.

2. Background of the Invention

An on-demand ink jet printing apparatus is known which forms an image on a recording sheet by jetting ink droplets from nozzles arranged on a print head.

When this on-demand ink jet printing apparatus performs printing by interleave scanning, for instance, unnecessary jetting of ink droplets by inputting, in scanning the outside of a printing area, printing data indicating prohibition of jetting to a head driving circuit. However, in this on-demand ink jet printing apparatus, the quality of a printed image is not good because it is formed according to presence/absence (two values) of ink dots.

On the other hand, the present assignee has improved the quality of a printed image by providing a two-liquid-mixing type ink jet printer (hereinafter referred to as "carrier jet printer") which can perform halftone printing by jetting a mixture of ink and a dilution liquid from nozzles.

However, in the above carrier jet printer, a transparent dilution liquid is jetted even when the printing data is "00," i.e., blank data, possibly soiling a recording sheet by forming a stain etc. Therefore, a means for preventing unnecessary jetting in the outside of a printing area is desired.

SUMMARY OF THE INVENTION

It is therefore an object of the present invention to provide an ink jet printing apparatus which resolves the above-mentioned problem.

It is another object of the invention to provide an ink jet printing apparatus control method which resolves the above-mentioned problem.

According to the invention, there is provided an ink jet printing apparatus including a print head and control means. The print head is moved with respect to a recording medium in the main scanning direction. The print head has N ink jetting portions arranged in an auxiliary scanning direction which is perpendicular to the main scanning direction. The N ink jetting portions are arranged at intervals that are K times the resolution element interval, where the ratio K/N is a fraction in lowest terms. The control means controls operations of the N ink jetting portions for each scan of the print head in the main scanning direction as the print head is scanned with respect to the recording medium in the main scanning direction and/or the auxiliary scanning direction.

According to the invention, there is provided a control method of an ink jet printing apparatus. The ink jet printing apparatus includes a print head which is moved with respect to a recording medium in the main scanning direction. The print head has N ink jetting portions arranged in an auxiliary scanning direction which is perpendicular to the main scanning direction. The N ink jetting portions are arranged at intervals that are K times the resolution element interval, where the ratio K/N is a fraction in lowest terms. The control method includes the steps of scanning the print head with respect to the recording medium in the main scanning direction and/or the auxiliary scanning direction, and controlling operations of the N ink jetting portions for each scan of the print head in the main scanning direction.

DESCRIPTION OF THE PREFERRED EMBODIMENTS

An ink jet printing apparatus according to the present invention will be hereinafter described in detail with reference to the accompanying drawings. In each of the following embodiments, a carrier jet printer will be described as an example of an ink jet printing apparatus.

Figure 1:
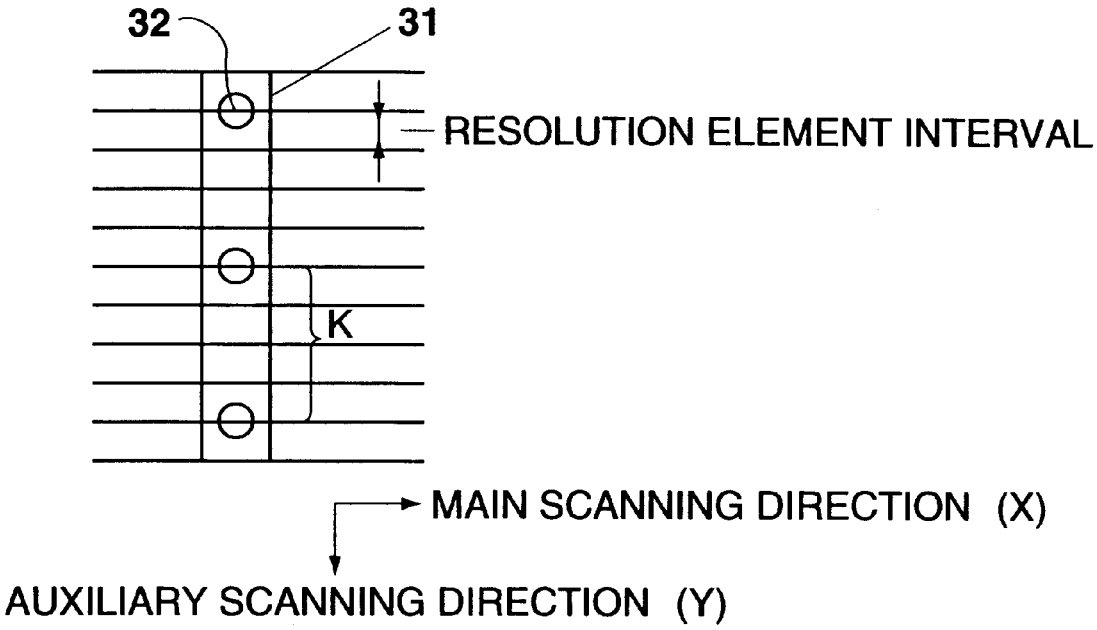
FIG. 1 illustrates a nozzle group of a print head which is a single recording head according to a first embodiment of the present invention.

First, a carrier jet printer according to a first embodiment of the invention will be described. FIG. 1 shows a nozzle group of a print head 31 used in the carrier jet printer according to the first embodiment.

On the print head 31, N nozzles 32 are arranged in the Y direction shown in FIG. 1, i.e., in the auxiliary scanning direction at K-dot intervals (dot: resolution element) where N and K are so set that the ratio K/N becomes a fraction in lowest terms. In the first embodiment, N=3 and K=4.

Figure 2A:
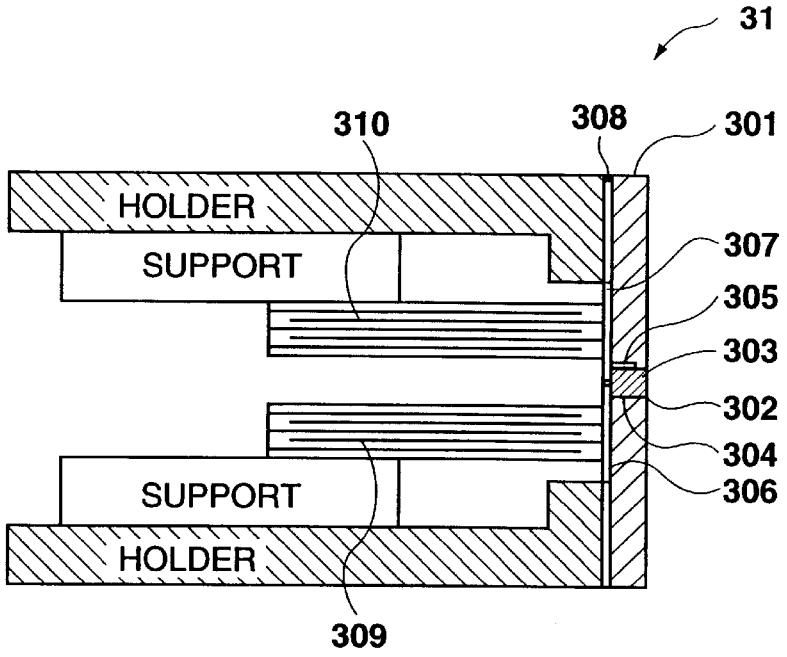
FIGS. 2A and 2B are sectional views illustrating an ink jetting mechanism of the print head of FIG. 1.
Figure 2B:
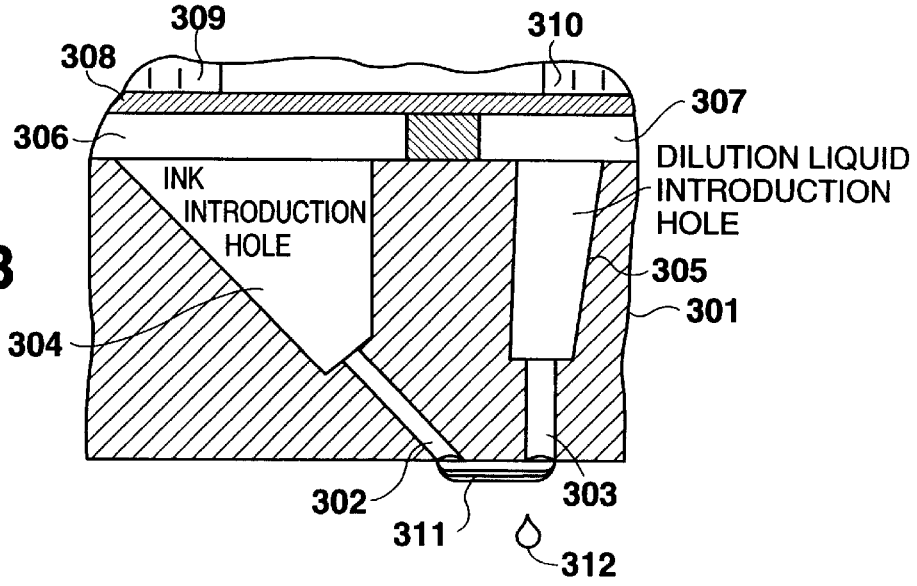

FIGS. 2A and 2B illustrate an ink jetting mechanism of the print head 31. The print head 31 performs halftone printing by using a mixed liquid obtained by mixing a given amount of dilution liquid and ink whose amount has been adjusted in accordance with print data.

FIG. 2A shows the entire configuration of the ink jetting mechanism, and FIG. 2B shows the structure of the main part of the ink jetting mechanism. An orifice plate 301 is provided with an amount-adjustment-side nozzle 302 and a jetting-side nozzle 303. An ink introduction hole 304 and a dilution liquid introduction hole 305 are connected, from behind, the respective nozzles 302 and 303.

The introduction holes 304 and 305 communicate with an amount-adjustment-side cavity 306 and a jetting-side cavity 307, respectively, and a vibration plate 308 is provided behind the cavities 306 and 307. The vibration plate 308 is driven by an amount-adjustment-side electrostrictive element 309 and a jetting-side electrostrictive element 310. For the details of the print head 31, reference is made to Japanese Patent Application No. Hei. 7-254250, for instance.

Figure 3A:
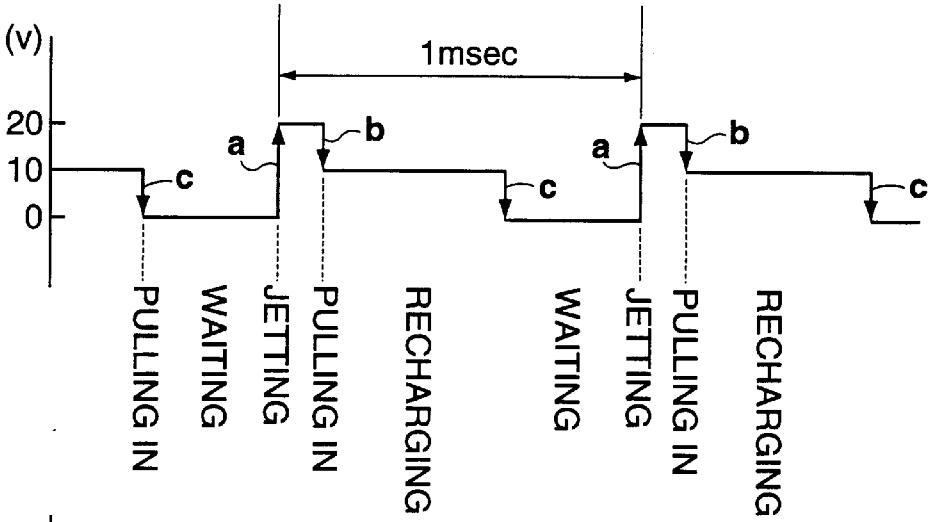
FIGS. 3A and 3B are timing charts showing drive signals that are supplied to a jetting-side electrostrictive element and an amount-adjustment-side electrostrictive element, respectively.
Figure 3B:
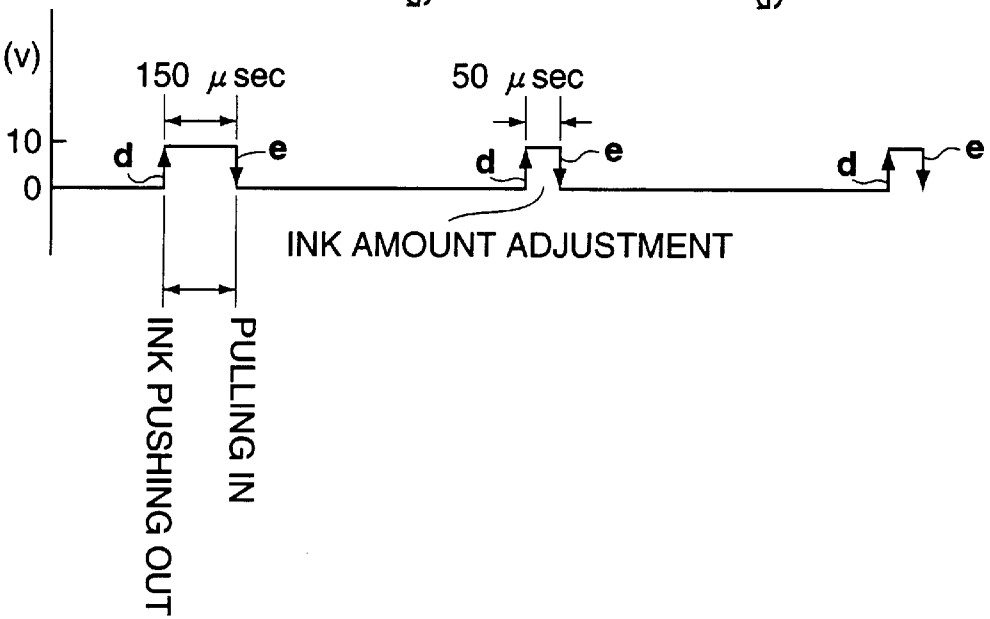

FIGS. 3A and 3B are timing charts showing drive signals that are supplied to the jetting-side electrostrictive element 310 and the amount-adjustment-side electrostrictive element 309, respectively. The jetting-side electrostrictive element 310 is given a large displacement at time a (see FIG. 3A), whereupon a dilution liquid filling up the dilution liquid introduction hole 305 is jetted from the jetting-side nozzle 303. The jetting-side electrostrictive element 310 is pulled in at each of times b and c (see FIG. 3A), and reintroduction of a dilution liquid into the dilution liquid introduction hole 305 from the jetting-side cavity 307 is started at time b.

FIG. 3B shows a drive signal that is supplied to the amount-adjustment-side electrostrictive element 309. During period d–e, ink is pushed out from the amount-adjustment-side nozzle 302 and an ink layer 311 thus pushed out remains in front of the jetting-side nozzle 303. When a dilution liquid is jetted from the jetting-side nozzle 303, ink is mixed into a droplet 312 of the dilution liquid by an amount corresponding to the thickness of the ink layer 311. It is noted that the adjusted amount of ink, i.e., the amount of jetted ink varies with period d–e.

The interval between time a (see FIG. 3A) is set at 1 msec, for instance. At this time point, a voltage of, for instance, 0–20 V is applied to the jetting-side electrostrictive element 310, and a dilution liquid is jetted due to a resulting mechanical displacement of the electrostrictive element 310. On the other hand, at time d (see FIG. 3B), a voltage of, for instance, 0–10 V is applied to the amount-adjustment-side electrostrictive element 309. But a displacement of the electrostrictive element 309 caused by this voltage does not induce ink jetting; ink is merely pushed out from the tip of the nozzle 302.

The thickness of the pushed-out ink layer 311 remaining in front of the jetting-side nozzle 303 can be controlled by the length of period d–e and the voltage, whereby the ink density of the jetted droplet 312 can be controlled arbitrarily. That is, printing can be performed at an arbitrary halftone level by controlling the length of period d–e (see FIG. 3B) and the voltage in accordance with print data to 150 $\mu$sec/10 V or 50 $\mu$sec/10 V, for instance.

Figure 4:
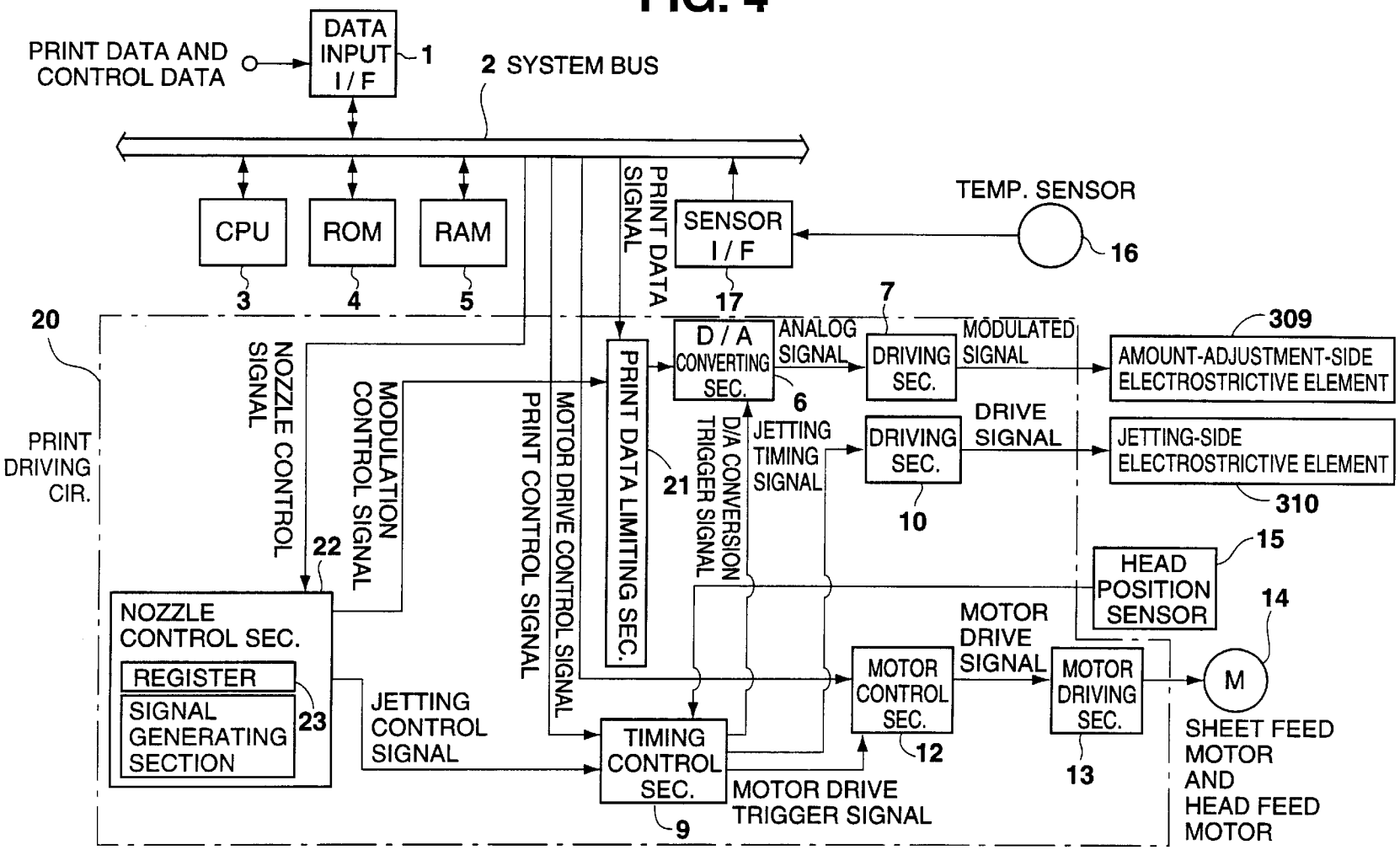
FIG. 4 is a block diagram showing the configuration of a control system of a printer according to the first embodiment.

Next, a description will be made of a control system of the carrier jet printer having the print head 31. FIG. 4 is a block diagram showing the configuration of a control system of the printer according to the first embodiment. The carrier jet printer has a data input interface (I/F) 1 connected to a system bus 2, a CPU 3 (microcomputer), a ROM 4, a RAM 5, a sensor I/F 17, and a print driving circuit 20.

The data input I/F 1 supplies the system bus 2 with print data and control data such as printer control instructions which are sent from a host computer (not shown). Examples of the data input I/F 1 are parallel interfaces such as IEEE 1284 (bidirectional centronix) and SCSI, and serial interfaces such as RS232C and RS422.

The print driving circuit 20 is provided with a print data limiting section 21, a nozzle control section 22, a D/A converting section 6, a timing control section 9, a motor control section 12, a motor driving section 13, and driving sections 7 and 10. The amount-adjustment-side electrostrictive element 309 and the jetting-side electrostrictive element 310 are connected to the driving sections 7 and 10, respectively.

A head position sensor 15 is connected to a timing control section. A sheet feed motor and a head feed motor 14 are connected to the motor driving section 13. A temperature sensor 16, which is provided in the vicinity of the nozzle 32 of the print head 31, is connected to the sensor I/F 17. The nozzle control section 22 is provided with registers 23 and signal generating sections.

Although to simplify the description the print driving circuit 20 includes the components for driving only one nozzle 32, actually the print data limiting section 21, the D/A converting section 6, the driving sections 7 and 10, the amount-adjustment-side electrostrictive element 309, and the jetting-side electrostrictive element 310 are provided in a number corresponding to the number of nozzles. The nozzle control section 22 incorporates the register 23 which can be set in accordance with the number of nozzles. Similarly, the timing control section 9 can perform control in accordance with the number of nozzles.

In the carrier jet printer having the above configuration, in driving the respective nozzles 32 of the print head 31 in each scan in accordance with the print processing described later, the CPU 3 controls both of the mixing and jetting operations of the carrier jet printer based on modulation control signals and jetting control signals.

The CPU 3 supplies a print data signal, which is sent from the host computer (not shown) via the data input I/F 1, to the print data limiting section 21 via the system bus 2. The print data limiting section 21 outputs the received print data signal to the D/A converting section 6 in accordance with the modulation control signal that is supplied from the nozzle control section 22. The D/A converting section 6 converts the print data signal that is supplied from the print data limiting section 21 to an analog signal and outputs the latter to the driving section 7. By outputting a modulated signal, the driving section 7 drives the amount-adjustment-side electrostrictive element 309 of the print head 31, thereby adjusting the amount of ink 311 in accordance with the print data.

The driving state of each nozzle 32 during a scan is set in the register 23 of the nozzle control section 22 based on a nozzle control signal that is supplied from the CPU 3. When a value "1" indicating a driving state "enabled" of each nozzle 32 is set in the register 23, it outputs a jetting control signal to the timing control section 9, whereupon the timing control section 9 enables a jetting operation of each nozzle 32 on a scanning line concerned. At the same time, the nozzle control section 22 outputs a modulation control signal to the print data limiting section 21, which forwards a print data signal to the D/A converting section 6 as described above.

On the other hand, when a value "0" indicating a driving state "disabled" of a certain nozzle 32 is set in a corresponding location of the register 23, a jetting control signal corresponding to that nozzle 32 is not outputted to the timing control section 9 and a jetting timing signal that is supplied from the timing control section 9 to the driving section 10 prohibits a jetting operation of that nozzle 32 during one scan. At the same time, the print data limiting section 21 outputs blank data "00" to the D/A converting section 6 rather than forwards a print data signal itself. With the blank data, the amount-adjustment-side electrostrictive element 309 is not given a voltage variation and hence no ink 311 is left in the head 31.

The timing control section 9 outputs a motor drive trigger signal to the motor control section 12. Upon receiving a motor drive control signal from the CPU 3 via the system bus 2, the motor control section 12 outputs a motor drive signal to the motor driving section 13, which drives the sheet feed motor and the head feed motor 14. Receiving a position detection signal from the head position sensor 15, the timing control section 9 detects the position of the print head 31.

Figure 5:
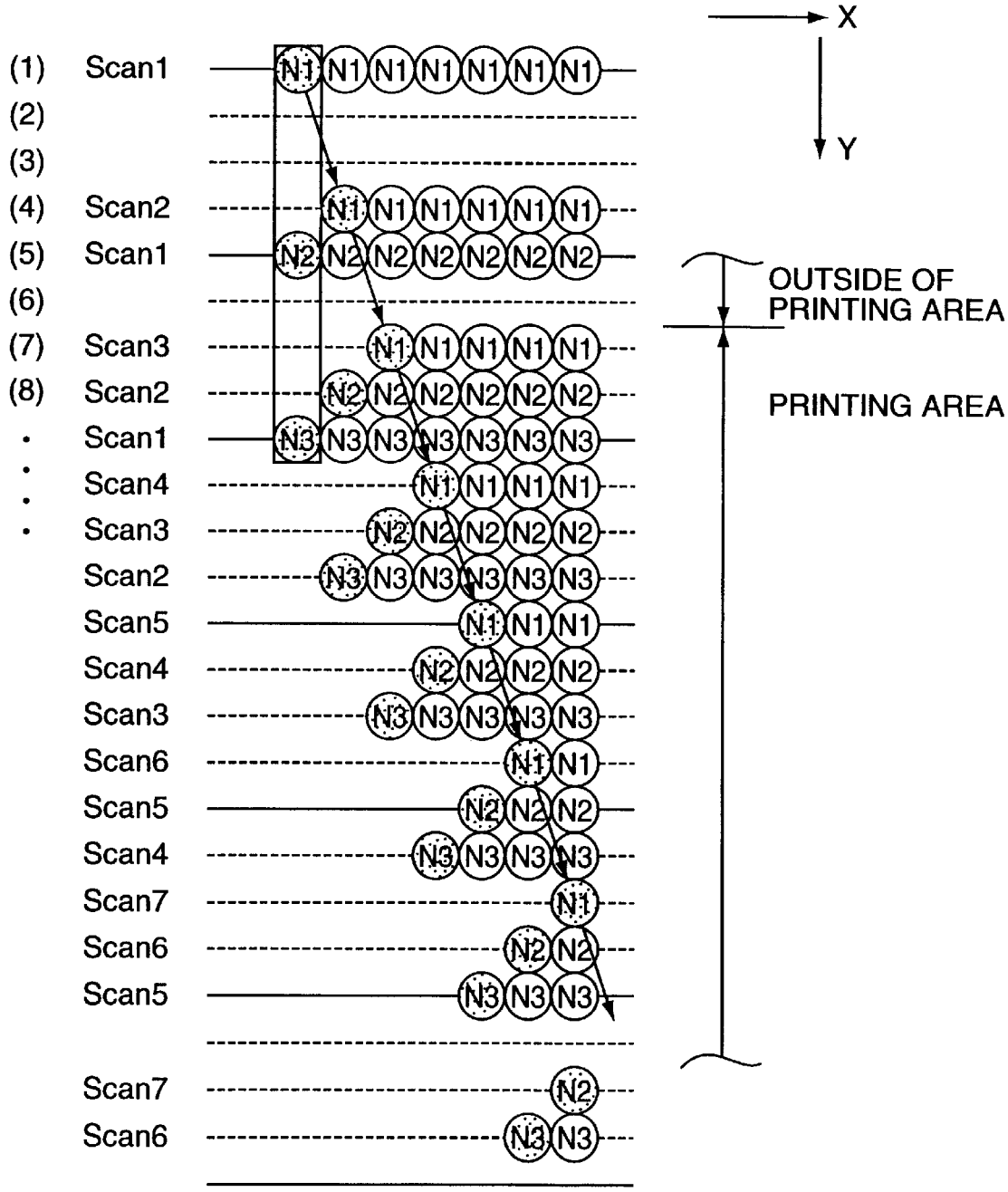
FIG. 5 illustrates print positions of a print head.

The print operation of the carrier jet printer having the above configuration will be described below. FIG. 5 illustrates print positions of the print head 31. It is noted that to facilitate understanding of the print positions, print start positions of respective scans are intentionally shifted in FIG. 5.

The print head 31 performs go-scan printing by an interleave operation (in the example of FIG. 5, 3-dot interleave scanning) from Scan1 at a dot interval of 300 dpi in each of the main scanning direction (indicated by arrow X in FIG. 5) and the auxiliary scanning direction (indicated by arrow Y in FIG. 5). In this case, scan line (1) to scan line (6) are blank lines outside the printing area and scan line (7) onward are located in the printing area. In the first scan (Scan1 in FIG. 5), a value "0" is set in the register 23 of the nozzle control section 22 to turn off modulation control signals and jetting control signals for nozzles N1 and N2. In the second scan (Scan2 in FIG. 5), a value "0" is set to turn off a modulation control signal and a jetting control signal for the nozzle N1. In the other scans, a value "1" is set to turn on modulation control signals and jetting control signals.

Values "0" and "1" are set in the register 23 for the respective nozzles in each scan in the above manner, and the print start position of the print head 31 is adjusted by feeding a recording sheet in the auxiliary scanning direction based on an output of the head position sensor 15 so that scan line (7) is located in the printing area on the recording sheet.

In the first scan (Scan1 in FIG. 5) of the print head 31, a value "0" is set in locations of the register 23 of the nozzle control section 22 which correspond to the nozzles N1 and N2 and hence corresponding modulation control signals and jetting control signals are off. Therefore, no ink mixing/jetting operations are performed with the nozzles N1 and N2. On the other hand, a value "1" is set in a location of the register 23 of the nozzle control section 22 which corresponds to the nozzle N3 and hence a corresponding modulation control signal and jetting control signal are on. Therefore, an ink mixing/jetting operation is performed with the nozzle N3.

In the second scan (Scan2 in FIG. 5) of the print head 31, a value "0" is set in the location of the register 23 of the nozzle control section 22 which corresponds to the nozzle N1 and hence a corresponding modulation control signal and jetting control signal are off. Therefore, no ink mixing/jetting operation is performed with the nozzle N1 as in the case of the first scan. A value "1" is set in the locations of the register 23 of the nozzle control section 22 which correspond to the nozzles N2 and N3 and hence corresponding modulation control signals and jetting control signals are on. Therefore, ink mixing/jetting operations are performed with the nozzles N2 and N3.

In the third scan (Scan 3 in FIG. 5) of the print head 31, a value "1" is set in the locations of the register 23 of the nozzle control section 22 which correspond to all of the nozzles N1 to N3 and hence corresponding modulation control signals and jetting control signals are on. Therefore, ink mixing/jetting operations are performed with all of the nozzles N1 to N3.

For example, the above ink mixing/jetting operations of the print head 31 are performed based on the output signal of the head position sensor 15 and the control signals supplied from the CPU 3. Naturally the ink mixing/jetting operations may be performed such that the CPU 3 judges based on the print data supplied from the host computer (not shown).

As described above, the jetting-side electrostrictive element 310 is not driven outside the printing area, i.e., on scan lines (1) to (6) (see FIG. 5), because a value "0" is set in the register 23 and hence the jetting control signal is off. Since the modulation control signal is off, the print data limiting section 21 does not forward the print data signal to the D/A converting section 6 and hence the amount-adjustment-side electrostrictive element 309 is not driven either. Therefore, this prevents ink from being jetted to a recording sheet outside the printing area as well as preventing that ink and a dilution liquid from being mixed together in the print head 31. No mixing is performed until reaching the printing area, and the mixing/jetting operation can correctly be performed from the first pixel of the first line of the printing area.

Outside the printing area, i.e., on scan lines (1) to (6), the timing control section 9 turns on/off the modulation control signals and the jetting control signals in accordance with values "0" and "1" that are set in the register 23 of the nozzle control section 22. In the printing area, i.e., on scan line (7) onward, the modulation control signals and the jetting control signals may be turned on without referring to the register 23. In this case, the load on the CPU 3 of setting values in the register for each scan can be reduced. The nozzles that should be enabled in each scan varies depending on the number of nozzles and the nozzle interval. Since the control method is uniquely determined by the number and the arrangement of nozzles, the CPU 3 is not necessarily required to set whether to enable or disable the respective nozzles for each scan; the timing control section 9 can control the modulation control signals and the jetting control signals by causing the nozzle control section 22 to count scanning signals that are supplied from the timing control section 9.

Although the above description is directed to the setting of the register 23 in a start portion of the printing area, a similar advantage can be obtained by setting the register 23 in a similar manner in an end portion of the printing area.

Next, a carrier jet printer according to a second embodiment of the invention will be described.

A print head 231 according to the second embodiment has recording heads of four colors, i.e., cyan (C), magenta (M), yellow (Y), and black (K). The components other than the print head 231 are the same as in the first embodiment.

Figure 6A:
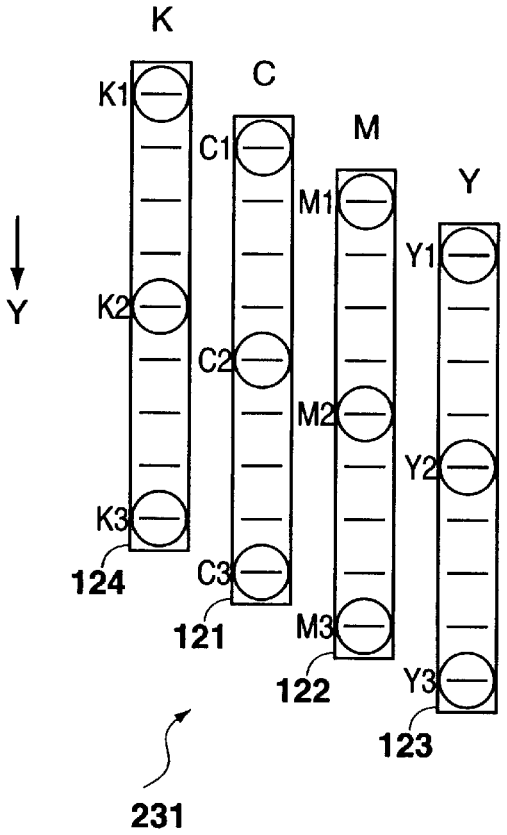
FIGS. 6A and 6B illustrate the arrangement of recording heads of four colors according to a second embodiment of the invention.

Referring to FIG. 6A, as in the case of the first embodiment, in each of recording heads 124, 121, 122, and 123 of the four colors K, C, M, and Y, three nozzles (N=3) are arranged at 4-dot intervals (K=4) in the auxiliary scanning direction (indicated by arrow Y in FIG. 6A), where the ratio K/N is a fraction in lowest terms.

Figure 6B:
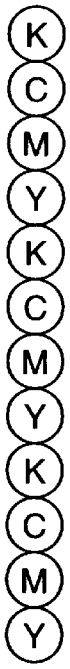

The recording heads 124, 121, 122, and 123 of the four colors K, C, M, and Y are so arranged that the adjacent heads are shifted by one dot in the auxiliary scanning direction, and printing of one scan is performed in order of K, C, M, and Y as shown in FIG. 6B. By arranging the recording heads of the four colors so that the adjacent heads are shifted by one dot, the printing order does not vary even if printing is performed by reciprocating the print head.

Where a plurality of heads for K, C, M, and Y as in the second embodiment, in the print driving circuit 20 (see FIG. 5) sets of the nozzle control section 22, the timing control section 9, the print data limiting section 21, the D/A converting section 6, and the driving sections 7 and 10 are independently provided for the respective heads.

Figure 7:
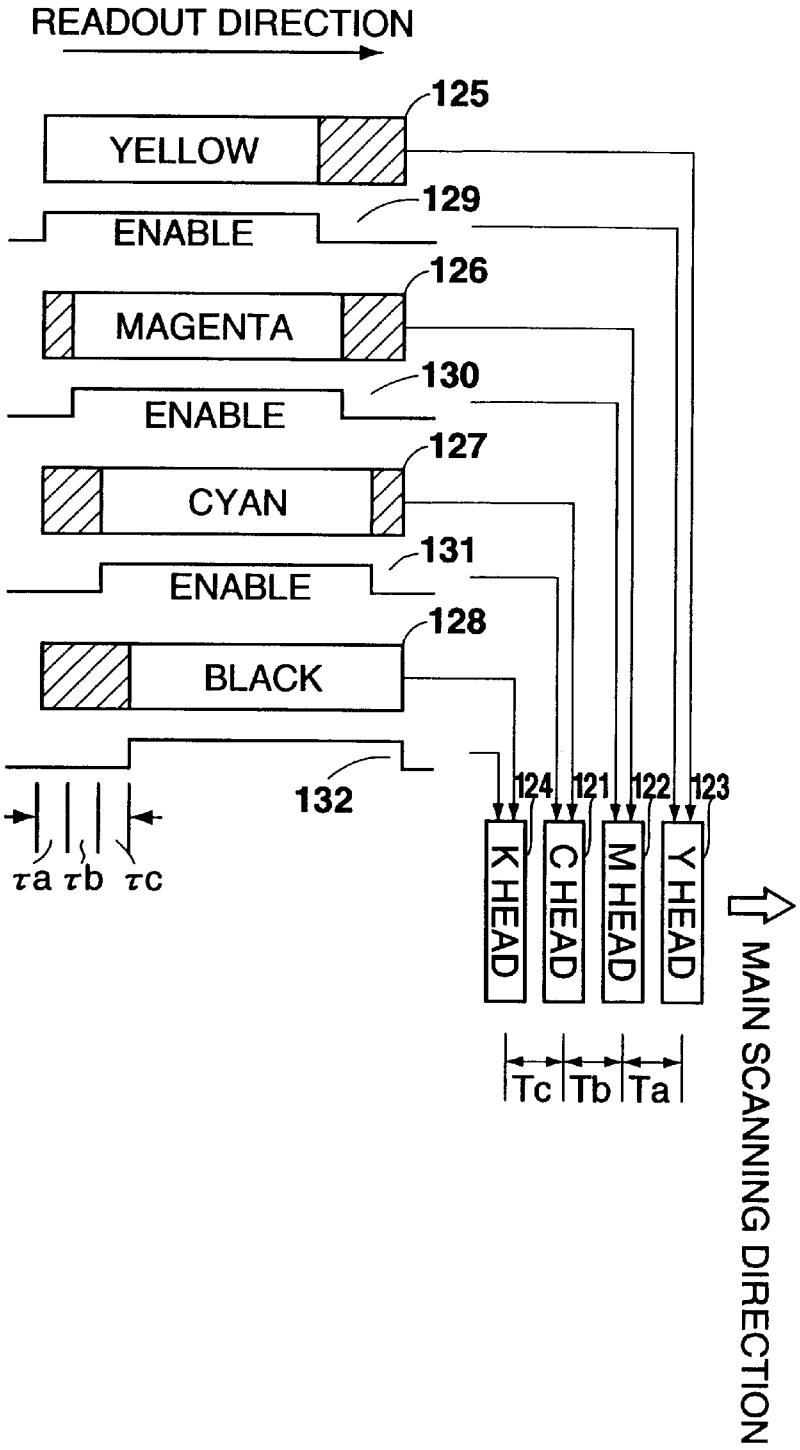
FIG. 7 illustrates a print operation of the recording heads of four colors in the main scanning direction.

FIG. 7 illustrates a print operation in the main scanning direction of the recording heads of the four colors shown in FIG. 6A. The RAM 5 is assigned print data memories 128, 127, 126, and 125 of one scan which have addresses corresponding to the recording heads 124, 121, 122, and 123 for K, C, M, and Y, respectively. Print data (image data of black, cyan, magenta, and yellow) are written in the print data memories 128, 127, 126, and 125 at locations determined by shifting the addresses by time intervals (τc, τb, and τa) corresponding to arrangement intervals (τc, τb, and τa) of the recording heads 124, 121, 122, and 123.

Signal generating sections (not shown) for generating main scanning direction enable signals 132, 131, 130, and 129 which indicate effective print data regions in the print data memories 128, 127, 126, and 125 corresponding to the recording heads for K, C, M, and Y are provided in the RAM 5 so as to correspond to the print data memories 128, 127, 126, and 125. Control data indicating main scanning direction enable signal intervals are written in the signal generating sections.

The signal generating sections are driven in synchronism with access to the print data memories 128, 127, 126, and 125, and print data are supplied from the print data memories 128, 127, 126, and 125 to the recording heads 124, 121, 122, and 123. At the same time, main scanning direction enable signals 132, 131, 130, and 129 are supplied from the signal generating sections to the print data control sections and the timing control sections 9 corresponding to the respective recording heads 124, 121, 122, and 123. The recording heads 124, 121, 122, and 123 performs mixing/jetting operations only during periods when the main scanning direction enable signals are at a high level.

In this manner, by simultaneously accessing the print data memories 128, 127, 126, and 125 in synchronism with the scanning by the recording heads 124, 121, 122, and 123 and reading print data at the same addresses, print data that are shifted by the time intervals corresponding to the arrangement intervals of the recording heads 124, 121, 122, and 123 are outputted from the respective print data memories 128, 127, 126, and 125 and the main scanning direction enable signals 132, 131, 130, and 129 indicating printing intervals are outputted from the signal generating sections.

Receiving the above print data and main scanning direction enable signals 132, 131, 130, and 129, the recording heads 124, 121, 122, and 123 sequentially perform multi-color printing operations at the given time intervals. Thus, unnecessary driving of the recording heads 124, 121, 122, and 123 can be prevented in intervals where the multi-color printing operations are not performed.

The signal generating sections can be formed by providing 1-bit-width memories having the sane addresses as the print data memories 128, 127, 126, and 125 in the RAM 5 and writing a value "1" at addresses corresponding to the print start position to the print end positions and a value "0" at the other addresses. Alternatively, the signal generating sections may be provided in the nozzle control section 22. Further, where the print head includes only one recording head as in the case of the first embodiment, the signal generating section may always output the main scanning direction enable signal during each scan because there is no need for shifting the time interval for reading print data.

Figure 8:
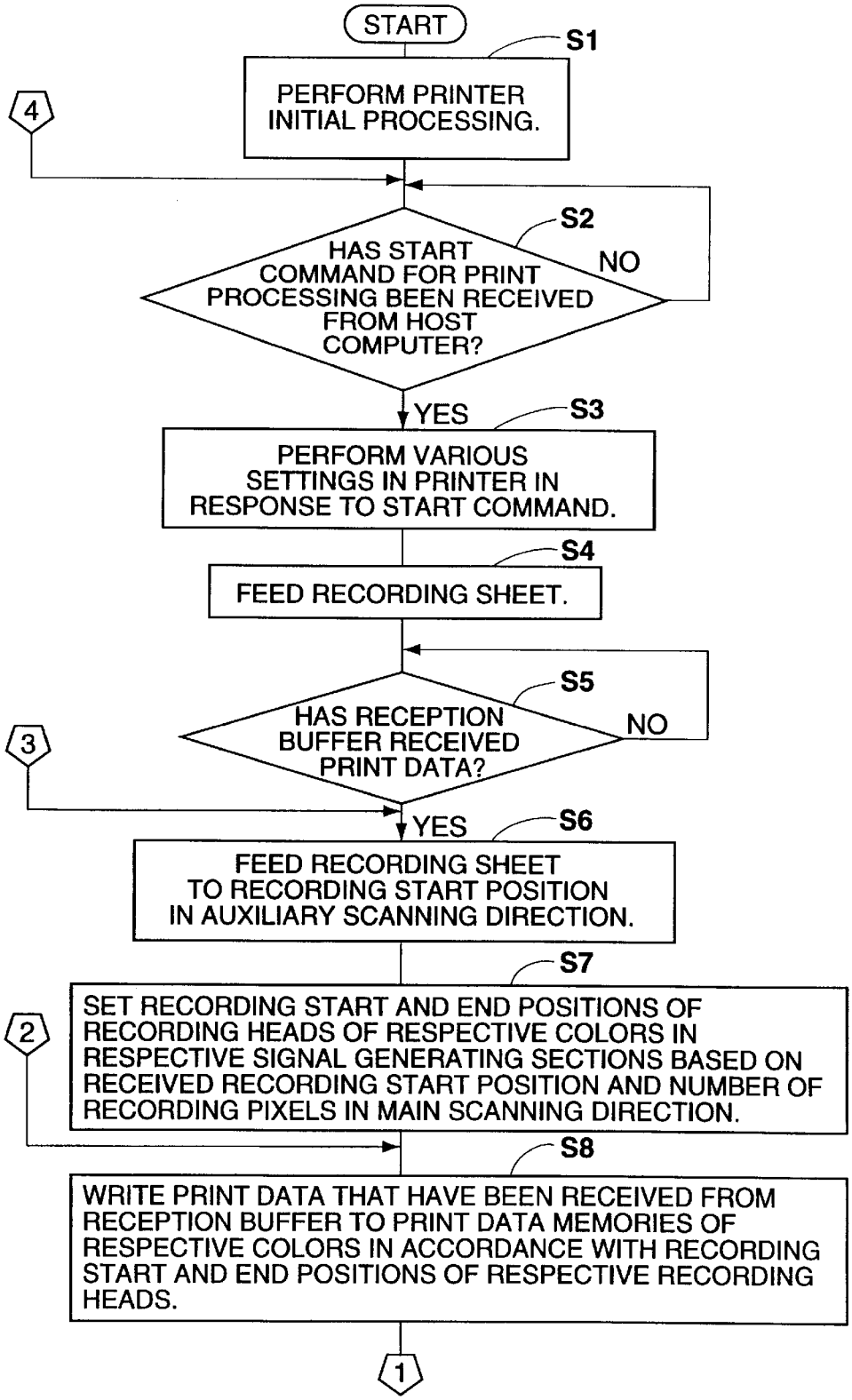
FIGS. 8 and 9 are a flowchart showing print processing executed by a CPU according to the second embodiment.
Figure 9:
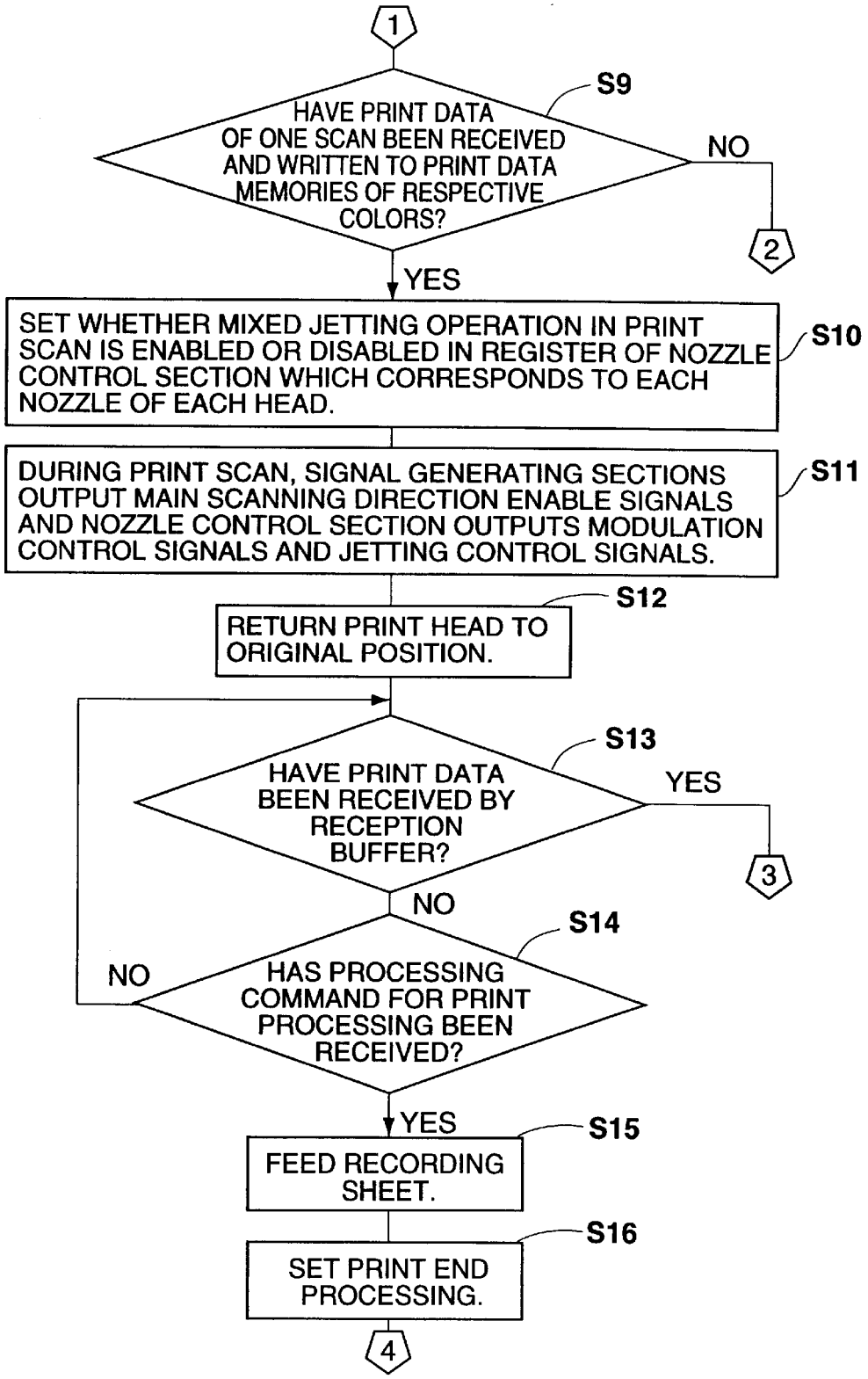

Next, a description will be made of the print operation of the carrier jet printer having the recording heads of the four colors. The print head performs printing by conducting 3-dot interleave scanning in the auxiliary scanning direction. Print processing that is executed by the CPU 3 will be described below with reference to a flowchart shown in FIGS. 8 and 9.

When the power is turned on, the CPU 3 performs initializing processing at step S1, so that an idling state is established. At step S2, the CPU 3 judges whether a start command for the print processing has been received from the host computer (not shown).

While the start command is not received from the host computer, the CPU 3 repeatedly executes step S2. If the start command is received, the CPU 3 performs various settings in the printer at step S3.

A recording sheet is fed at step S4, and the CPU 3 judges at step S5 whether a reception buffer of the RAM 5 has received print data. If the reception buffer has not received any print data, the CPU 3 repeatedly executes step S5 to wait for reception of print data. If the reception buffer has received print data, a recording sheet is feed to a recording start position in the auxiliary scanning direction at step S6.

At step S7, the CPU 3 reads a recording start position in the main scanning direction and the number of recording pixels in the main scanning direction from the received print data, and sets recording start and end positions of the respective recording heads in the signal generating sections.

At step S8, the print data received from the reception buffer of the RAM 5 are written to the print data memories 128, 127, 126, and 125 in accordance with the recording start and end positions of the respective recording heads.

At step S9, the CPU 3 judges whether print data of one scan have been received and written to the print data memories 128, 127, 126, and 125. If print data have not been written to the print data memories 128, 127, 126, and 125, the process returns to step S8.

If print data have been written to the print data memories 128, 127, 126, and 125, at step S10 the CPU 3 sets in the register 23, in the forms of a value "1" or "0," whether a mixing/jetting operation of each nozzle is enabled or disabled.

In the first scan, a value "0" is set in the register 23 of the nozzle control section 22 so that modulation control signals and jetting control signals for nozzles K1, K2, and K3 of black (K), nozzles C1 and C2 of cyan (C), nozzles M1 and M2 of magenta (M), and nozzles Y1 and Y2 of yellow (Y) are turned off.

In the second scan, a value "0" is so set that modulation control signals and jetting control signals for the nozzles K1 and K2 of black (K), the nozzles C1 and C2 of cyan (C), the nozzle M1 of magenta (M), and the nozzle Y1 of yellow (Y) are turned off.

In the third scan, a value "0" is so set that modulation control signals and jetting control signals for the nozzle K1 of black (K), the nozzle C1 of cyan (C), and the nozzle M1 of magenta (M) are turned off.

In the fourth scan, a value "1" is so set that modulation control signals and jetting control signals for all the nozzles of K, C, M, and Y are turned on.

When the print head 231 performs printing of one scan, the signal generating sections corresponding to the respective recording heads 124, 121, 122, and 123 output main scanning direction enable signals to the print data limiting sections 21 and the timing control sections 9 in accordance with actual printing positions and the nozzle control section 22 outputs modulation control signals and jetting control signals corresponding to the respective nozzles to the print data limiting sections 21 and the timing control sections 9, respectively (step S11).

At step S12, the print head 231 is returned to the original position. In the second embodiment, printing is performed in go scans of the print head 231.

At step S13, the CPU judges whether the reception buffer of the RAM 5 has received print data. If the reception buffer has received print data, the process returns to step S6. If the reception buffer has not received any print data, the CPU 3 judges at step S14 whether a processing command for the print processing has been received. If no processing command has been received yet, the process returns to step S13. If a processing command has been received, the recording sheet is discharged at step S15. Then, the CPU 3 sets print end processing at step S16, so that the process returns to an idling state.

Figure 10:
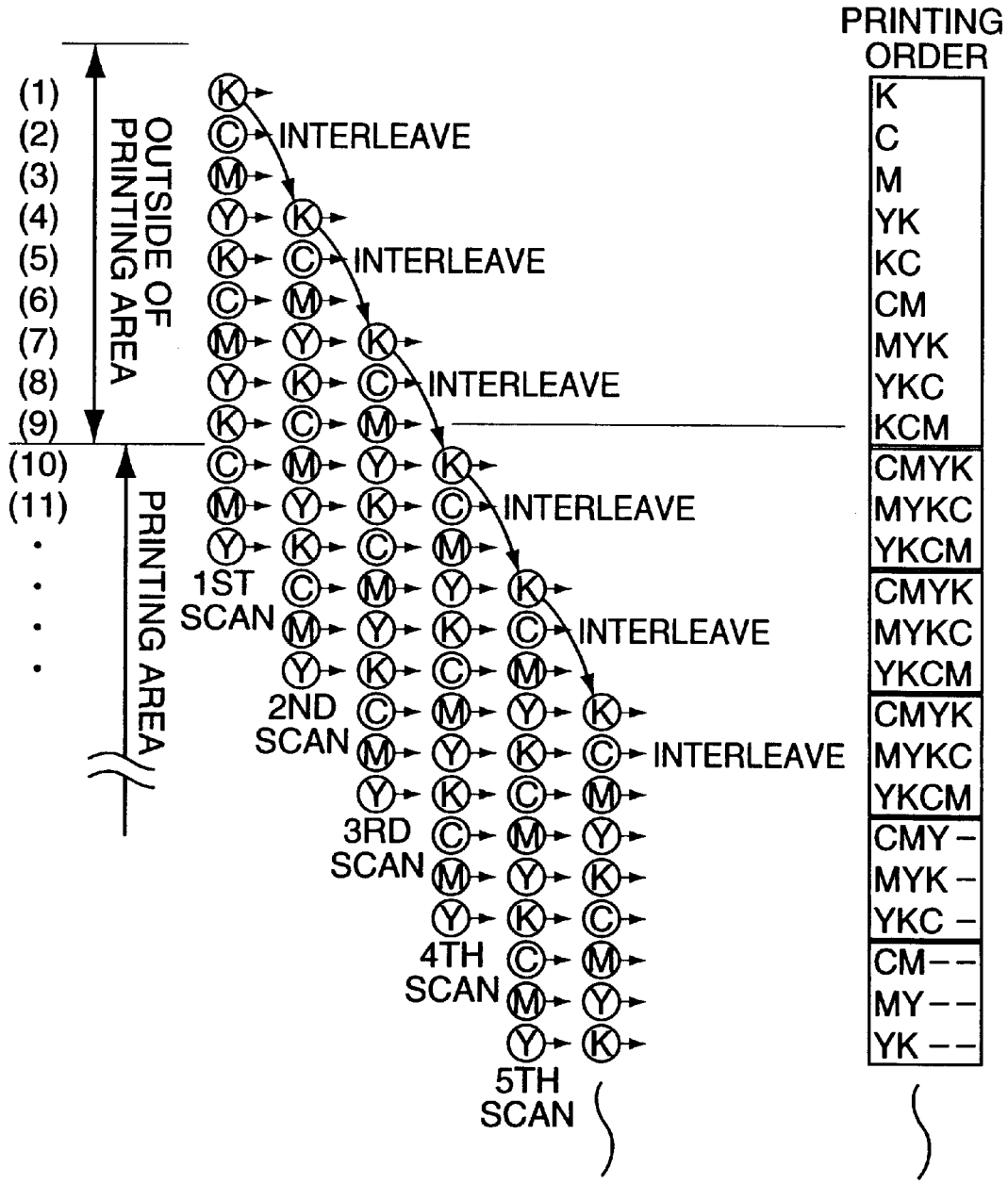
FIG. 10 illustrates print positions of the recording heads of four colors shown in FIG. 6A.

FIG. 10 illustrates print positions of the recording heads of the four colors shown in FIG. 6A. Outside the printing area, i.e., on scan lines (1) to (9), the jetting control signals are off and hence the jetting-side electrostrictive elements 310 of the respective recording heads are not driven. The amount-adjustment-side electrostrictive elements 309 are not driven either because the modulation control signals are off and hence the print data limiting section 21 do not forward print data signals to the D/A converting sections 6. Therefore, outside the printing area, it can be prevented that ink of any of K, C, M, and Y is jetted to a recording sheet. It can also be prevented that ink of any of K, C, M, and Y is mixed with a dilution liquid in the print head 231; the two kinds of liquids are not mixed together until reaching the printing area. Thus, the mixing/jetting operation can be performed correctly from the first pixel of the first line of the printing area, and wasted consumption of a dilution liquid used in the carrier jet printer can be prevented.

Next, a carrier jet printer according to a third embodiment of the invention will be described.

Figure 11:
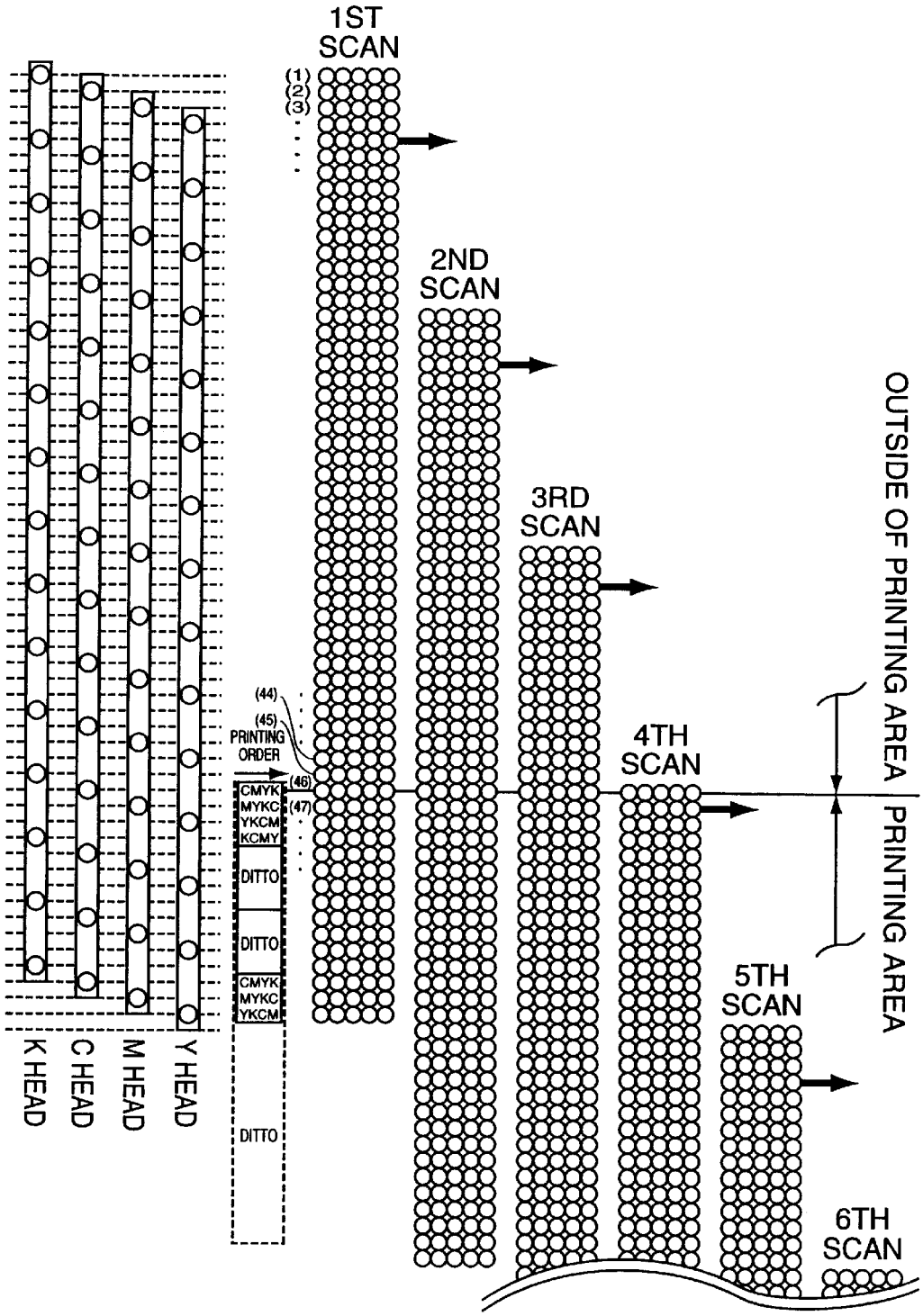
FIG. 11 illustrates print positions of respective recording heads each having a number of nozzles according to a third embodiment of the invention.

The third embodiment is the same as the second embodiment in that recording heads of four colors K, C, M, and Y are used. However, in the third embodiment, 15 nozzles are arranged in each recording head. FIG. 11 illustrates print positions of the respective recording heads each having so large a number of nozzles.

In each of the recording heads of the four colors K, C, M, and Y, 15 nozzles (N=15) are arranged at 4-dot intervals (K=4) in the auxiliary scanning direction, where the ratio K/N is a fraction in lowest terms. The recording heads of the four colors K, C, M, and Y are so arranged that the adjacent heads are shifted by one dot in the auxiliary scanning direction, as shown in FIG. 11.

As in the case of the second embodiment, in the first to third scans, a value "0" is set in locations of the register 23 corresponding to the respective nozzles so that modulation control signals and jetting control signals for nozzles that are located outside the printing area, i.e., scan lines (1) to (45), are turned off.

Since the jetting control signals are off, the jetting-side electrostrictive elements 310 of the nozzles outside the printing area are not driven. The amount-adjustment-side electrostrictive elements 309 are not driven either because the modulation control signals are off and hence the print data limiting section 21 do not forward print data signals to the D/A converting sections 6. Therefore, as in the case of 2, the second embodiment, it can be prevented that ink of any of K, C, M, and Y is jetted to a recording sheet outside the printing area. The inside of the printing area can be printed in multiple colors.

Although in the third embodiment the mixing operation is suspended together with the jetting operation, the carrier jet printer may be adapted to control the suspension of only the jetting operation, in which case the configuration of the print driving circuit can be simplified.

The above embodiments are directed to the case where the invention is applied to the ink jet printer in which the electromechanical conversion element as typified by a piezoelectric element (electrostrictive element) is used and ink is jetted by a pressure variation that is caused by a mechanical displacement in the electromechanical conversion element. A similar advantage can be obtained even by applying the invention to what is called a bubble jet printer in which ink is jetted by using bubbles that are formed by heating a heating element.

Although in the above embodiments printing is performed by go scans of the print head in the main scanning direction, printing may be performed by both of go scans and return scans.

What is claimed is:

1. An ink jet printing apparatus comprising:

a print head that is moved with respect to a recording medium in a main scanning direction, the print head having N ink jetting portions arranged in an auxiliary scanning direction that is perpendicular to the main scanning direction, wherein the N ink jetting portions are arranged at intervals that are K times a resolution element interval, K and N being integers and where a ratio K/N is a fraction in its lowest terms, and wherein the print head has an ink jetting mechanism provided for each of the N ink jetting portions, for mixing ink with a dilution liquid and jetting a resulting mixture from the ink jetting portion; and control means for controlling operation of the N ink jetting portions for each scan of the print head in the main scanning direction as the print head is scanned with respect to the recording medium in the main scanning direction or the auxiliary scanning direction.

2. The ink jet printing apparatus according to claim 1, wherein the control means instructs the N ink jetting portions of the print head to start sequential jetting operations upon reaching a print start position on the recording medium as the print head is moved relative to the recording medium in the main scanning direction or the auxiliary scanning direction.

3. The ink jet printing apparatus according to claim 2, wherein the control means stops operation of the N ink jetting portions that have not reached the print start position.

4. The ink jet printing apparatus according to claim 1, wherein the control means comprises:

a driving section for driving the N ink jetting portions of the print head and a control section that controls the driving section by enabling or disabling the driving section to drive the N ink jetting portions in accordance with a position of the print head with respect to the recording medium.

5. The ink jet printing apparatus according to claim 4, wherein the driving section comprises a register in which the control section sets operation states of the N ink jetting portions, and wherein the driving section controls operations of the N ink jetting portions based on the operation states set in the register.

6. The ink jet printing apparatus according to claim 5, wherein the driving section comprises a signal processing section for supplying blank data to at least one of the N ink jetting portions whose operation is to be stopped.

7. The ink jet printing apparatus according to claim 4, wherein the control section causes the N ink jetting portions of the print head to start sequential jetting operations upon reaching a print start position on the recording medium as the print head is moved relative to the recording medium in the main scanning direction or the auxiliary scanning direction.

8. The ink jet printing apparatus according to claim 7, wherein the control section stops operation of the N ink jetting portions that have not reached the print start position.

9. The ink jet printing apparatus according to claim 1, wherein the print head has groups of N ink jetting portions, the groups being shifted sequentially in the auxiliary scanning direction to form a step-like arrangement with respect to the recording medium.

10. A method for controlling an ink jet printing apparatus having a print head that is moved with respect to a recording medium in a main scanning direction, the print head having N ink jetting portions arranged in an auxiliary scanning direction that is perpendicular to the main scanning direction, the N ink jetting portions being arranged at intervals that are K times a resolution element interval, K and N being integers and where a ratio K/N is a fraction in its lowest terms, the method comprising the steps of:

scanning the print head with respect to the recording medium in the main scanning direction and/or the auxiliary scanning direction;

mixing ink with a dilution liquid in an ink jetting mechanism provided for each of the N ink jetting portions; and controlling operations of the N ink jetting portions for each scan of the print head in the main scanning direction.

11. The method according to claim 10, wherein the controlling step includes causing the N ink jetting portions of the print head to start sequential jetting operations upon reaching a print start position of the recording medium as the print head is moved relative to the recording medium in the main scanning direction or the auxiliary scanning direction.

12. The method according to claim 11, wherein the controlling step includes stopping operation of the N ink jetting portions that have not reached the print start position.

* * * * *